US005558242A

United States Patent [19]

Kuan

[11] Patent Number: 5,558,242

[45] Date of Patent: Sep. 24, 1996

[54] STRUCTURE OF OUTER CASE

[76] Inventor: Hung Kuan, P.O. Box 82-144, Taipei, Taiwan

[21] Appl. No.: 580,496

[22] Filed: Nov. 29, 1995

[51] Int. Cl.[6] ..... B65D 6/22

[52] U.S. Cl. ..... 220/4.31; 220/4.33; 220/676

[58] Field of Search ..... 220/4.31, 4.33, 220/4.34, 6, 7, 1.5, 4.01, 4.28, 676, 666, 693; 217/36, 43, 43 A, 17, 65; 206/386, 400

[56] References Cited

U.S. PATENT DOCUMENTS

| | | | |
|---|---|---|---|
| 1,594,029 | 7/1926 | Woolsey | 217/65 |
| 1,804,494 | 5/1931 | Brown | 217/65 |
| 2,192,949 | 3/1940 | Wich | 217/17 |
| 2,471,693 | 5/1949 | Lilienfeld | 217/43 |
| 3,266,656 | 8/1966 | Kridle | 220/4.33 |
| 3,401,814 | 9/1968 | Chiswell et al. | 220/4.33 |
| 4,807,808 | 2/1989 | Reed | 220/4.28 |
| 5,415,311 | 5/1995 | Coogan | 220/1.5 |

FOREIGN PATENT DOCUMENTS

| | | | |
|---|---|---|---|
| 9401333 | 1/1994 | WIPO | 220/4.33 |

*Primary Examiner*—Stephen J. Castellano
*Attorney, Agent, or Firm*—Alfred Lei

[57] ABSTRACT

An outer case including a rectangular base having four upright side walls of different heights; pairs of supports respectively hinged to two opposite ends of each of the four upright side walls of the base by hinges; a plurality of mounting blocks respectively fastened to the supports and arranged in stack on each support, each mounting block having a center through hole for the insertion of one support, a mounting groove at one end, and a sliding groove at an opposite end; a plurality of wedges respectively fitted into the mounting grooves of the mounting blocks to fastened them together and to secure the supports in vertical; and a plurality of transverse panels respectively fastened to the mounting blocks between each pair of supports to close the four sides of the outer case, each transverse panel having two opposite ends respectively fitted into the sliding grooves of the mounting blocks; a top cover covered on the outer case at the top side; and a circular outlet made on one upright side wall of the base and one transverse panel.

1 Claim, 3 Drawing Sheets

STRUCTURE OF OUTER CASE

BACKGROUND OF THE INVENTION

1. Field of the Invention

The present invention relates to an outer case for holding a bag for storing liquid materials, and relates more particularly to such an outer case which can be conveniently collapsed when not in use.

2. Description of the Prior Art

Regular outer cases for holding bags for storing liquid materials are commonly made of metal frame bars or wooden slats in a latticed structure. These outer cases cannot protect against vermin and animals. Furthermore, these outer cases need much storage space when not in use because they are not collapsible.

SUMMARY OF THE INVENTION

This invention relates to an improved structure of an outer case.

According to the preferred embodiment of the present invention, the outer case comprises a rectangular base having four upright side walls of different heights; pairs of supports respectively hinged to two opposite ends of each of the four upright side walls of the base by hinges; a plurality of mounting blocks respectively fastened to the supports and arranged in stack on each support, each mounting block having a center through hole for the insertion of one support, a mounting groove at one end, and a sliding groove at an opposite end; a plurality of wedges respectively fitted into the mounting grooves of the mounting blocks to fastened them together and to secure the supports in vertical; and a plurality of transverse panels respectively fastened to the mounting blocks between each pair of supports to close the four sides of the outer case, each transverse panel having two opposite ends respectively fitted into the sliding grooves of the mounting blocks; a top cover covered on the outer case at the top side; and a circular outlet made on one upright side wall of the base and one transverse panel.

DETAILED DESCRIPTION OF THE PREFERRED EMBODIMENT

Figure 1:
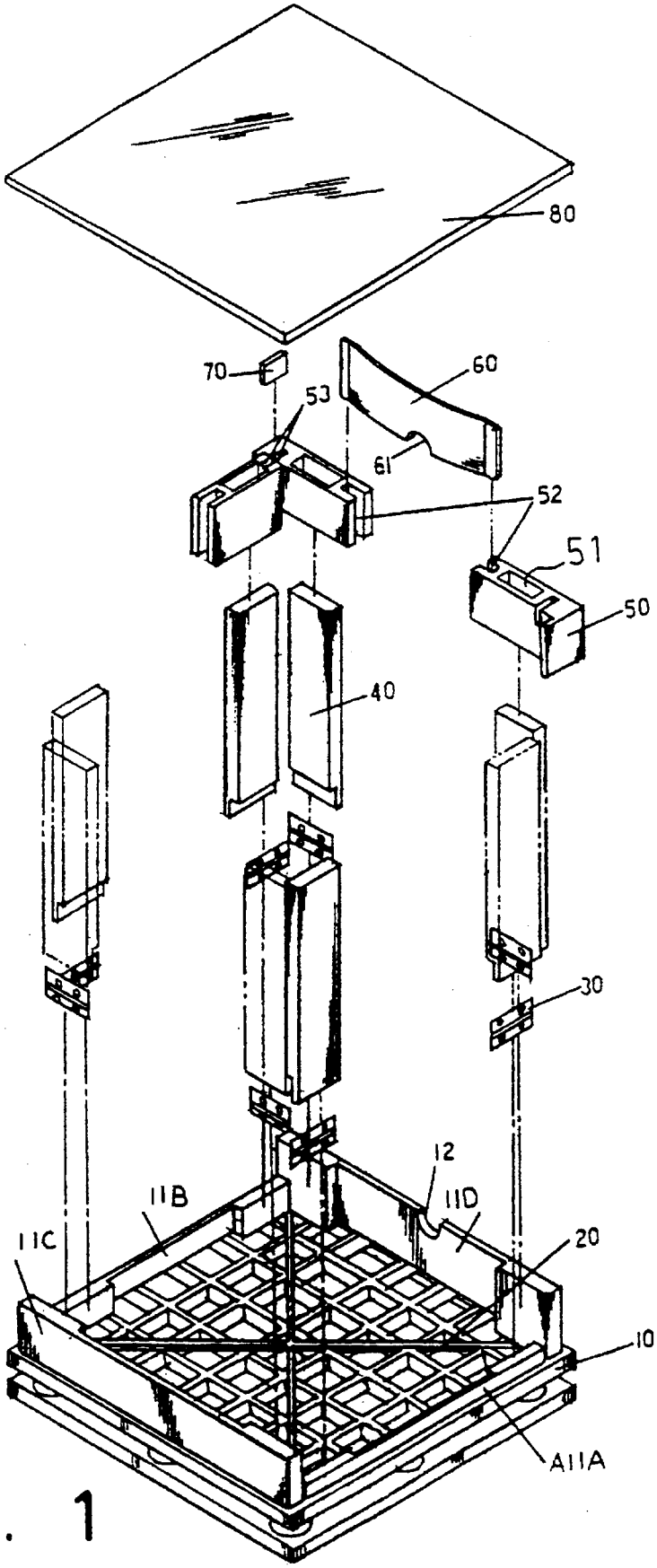
FIG. 1 is an exploded view of an outer case according to the present invention.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Referring to the annexed drawings in detail, an outer case in accordance with the present invention is generally comprised of a base 10, a metal frame 20 mounted within the base 10, pairs of supports 40 respectively hinged to the upright side walls 11 of the base 10 by hinges 30, a plurality of mounting blocks 50 respectively fastened to the supports 40, a plurality of transverse panels 60 respectively connected between the mounting blocks 50 at each side of the base 10, a plurality of wedges 70, which connect the mounting blocks 50 together, and a top cover 80 covered on the supports 40, the mounting blocks 50, and the transverse panels 60 at the top side opposite to the base 10.

Figure 4:
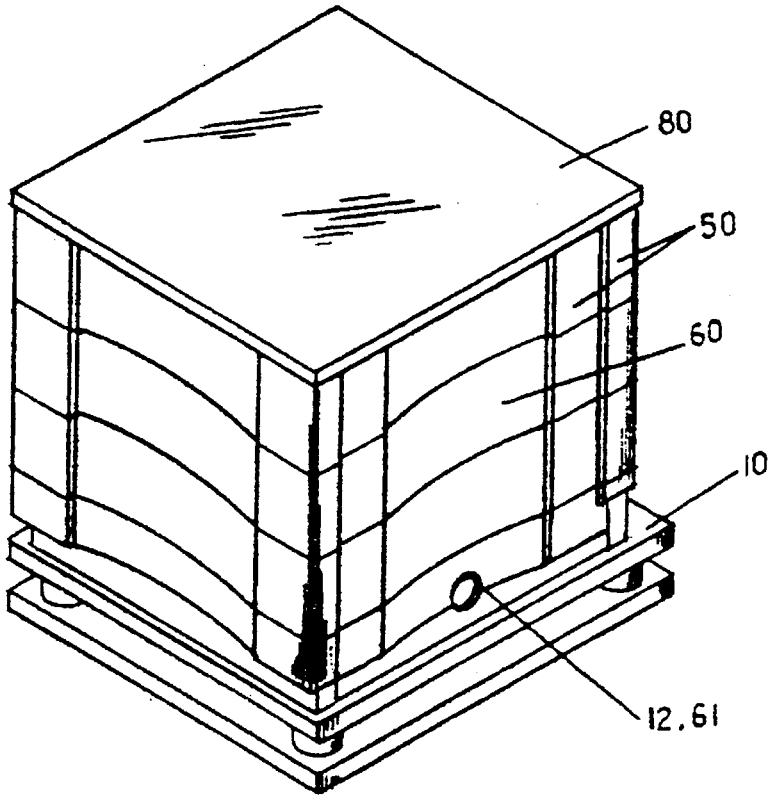
FIG. 4 is an elevational view of the outer case according to the present invention.

Referring to FIGS. 1, 2, and 4 again, the base 10 is made of rectangular shape having four upright side walls 11, namely, the first upright side wall 11A and the second upright side wall 11B at two opposite sides, the third upright side wall 11C and the fourth upright side walls 11D respectively connected between the first upright side wall 11A and the second upright side wall 11B at two opposite sides at two opposite sides. The fourth upright side wall lid has a half-round notch 12 in the middle of the top side thereof. The height of the second upright side wall 11B is approximately equal to the height of the first upright side wall 11A plus the height of each of the mounting blocks 50. The height of the third upright side wall 11C is approximately equal to the height of the second upright side wall 11B plus the height of each of the mounting blocks 50. The height of the fourth upright side wall 11D is approximately equal to the height of the third upright side wall 11C plus the height of each of the mounting blocks 50. The pairs of supports 40 are respectively hinged to the two opposite ends of each of the upright side walls 11 of the base 10 by the hinges 30. Therefore, the supports 40 can be respectively turned between a horizontal position (the collapsed position) and a vertical position (the operative position). When the supports 40 are respectively turned to the operative position, the mounting blocks 50 are respectively fastened to the supports 40 and then connected together by the wedges 70. Each of the mounting blocks 50 has a center through hole 51 for the insertion of one support 40, a sliding groove 52 at one end for mounting one transverse panel 60, and a mounting groove 53 at an opposite ends for mounting one wedge 70. By inserting the supports 40 into the center through holes 51 of the mounting blocks 50, the mounting blocks 50 are respectively fastened to the supports 40 and arranged in a stack on each support 40. When the mounting blocks 50 are respectively fastened to the supports 40, the wedges 70 are respectively fastened to mounting grooves 53 of each two adjacent mounting blocks 50, which are arranged on the same elevation at two adjacent upright side walls 11 of the base 10, to retain the supports 40 and the mounting blocks 50 together and to prohibit the supports 40 from being turned from the operative position to the collapsed position. Then, the transverse panels 60 are respectively fastened to the mounting blocks 50 by inserting the two opposite ends of each of the transverse panels 60 into the sliding grooves 52 of the mounting blocks 50. When the transverse panels 60 are respectively fastened to the mounting blocks 50, they are respectively connected between each two supports 40 to close the four sides of the outer case. One of the transverse panels 60 has a half-round notch 61 in the middle at the bottom which matches with the half-round notch 12 on the fourth upright side wall lid of the base 10 into a circular outlet hole for output of the liquid material stored in an inner bag (not shown) inside the outer case. When assembled, the top cover 80 is covered on the supports 40, the mounting blocks 50, and the transverse panels 60 at the top side opposite to the base 10.

Figure 2A:
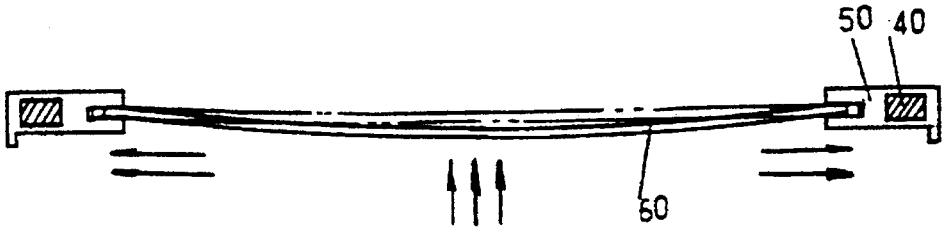
FIG. 2A is a sectional view showing the transverse panel stretched between two mounting blocks according to the present invention.
Figure 2:
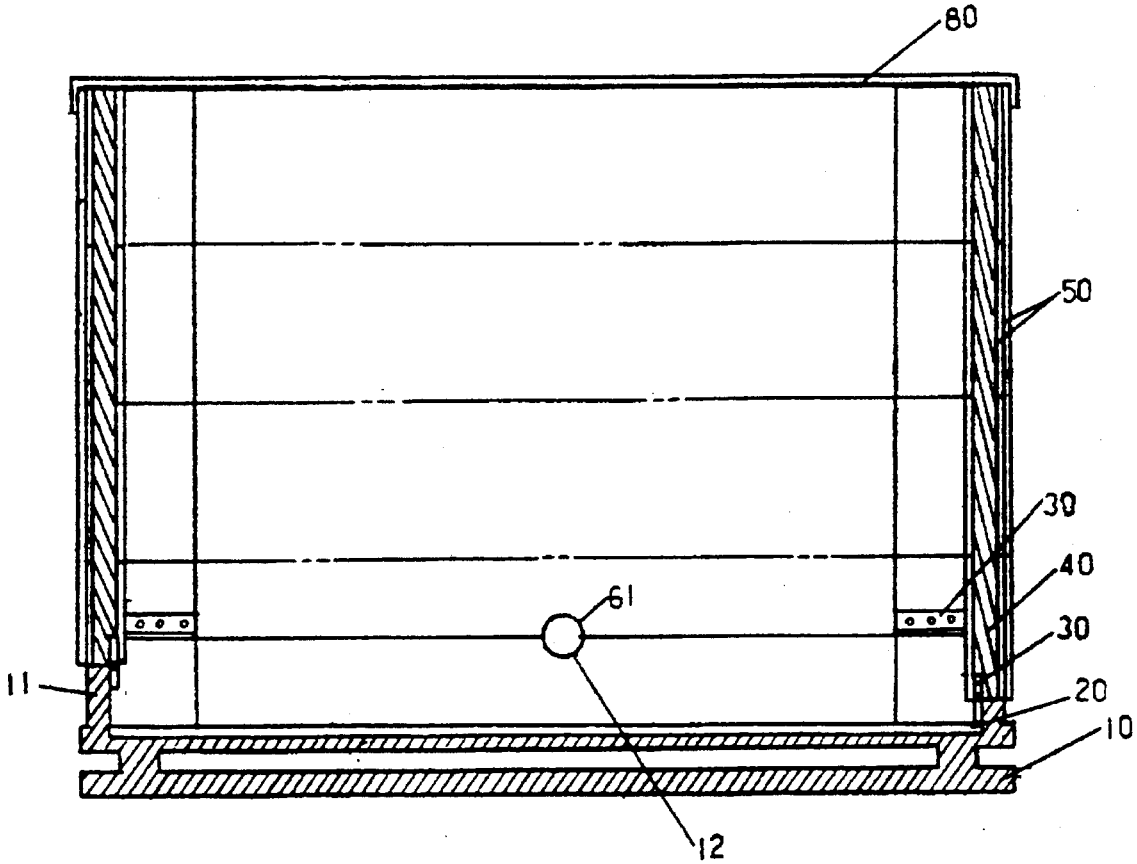
FIG. 2 is a sectional assembly view of the outer case shown in FIG. 1.

Referring to FIG. 2A, the transverse panels 60 are made of resilient material. Each of the transverse panels 60 is smoothly curved. When the transverse panels 60 are installed, a gap is still maintained between one end of each transverse panel 60 and the respective mounting block 50 within the respective sliding groove 52. Therefore, when the transverse panels 60 are forced outwards by the liquid material in the inner bag, they will be stretched from the smoothly curved configuration to a straight shape to absorb the pressure.

Figure 3:
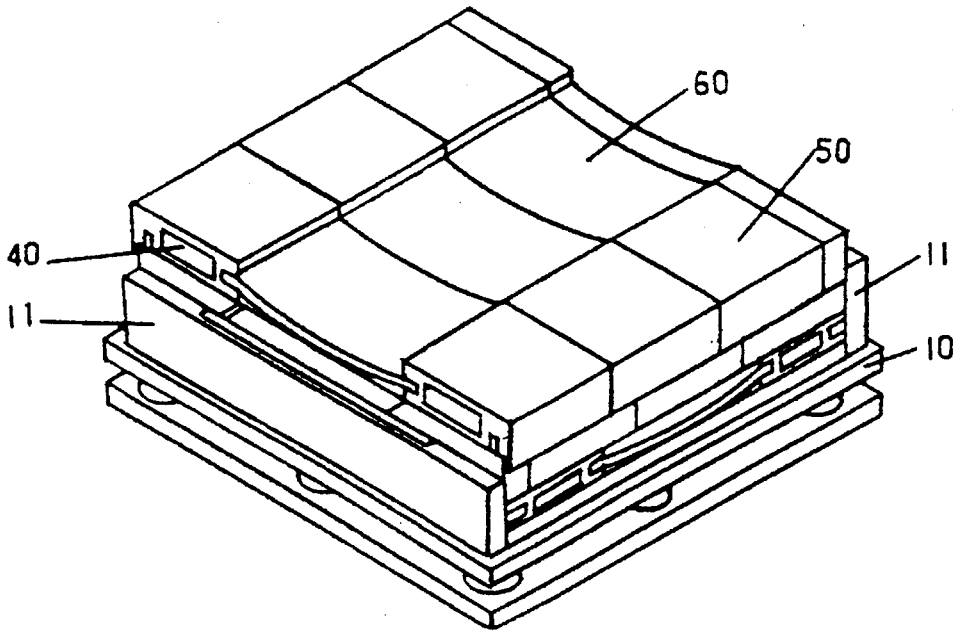
FIG. 3 shows the outer case collapsed.

Referring to FIG. 3, after the removal of the top cover 80 and the wedges 70, the four sides of the outer case can be turned to the collapsed position and overlapped one another above the metal frame 20.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. An outer case comprising:

a rectangular base having four upright side walls of different heights, one upright side wall having a half-round notch in the middle at at top side;

a metal frame mounted within said base;

pairs of supports respectively hinged to two opposite ends of each of the four upright side walls of said base by hinges;

a plurality of mounting blocks respectively fastened to said supports and arranged in stack on each support, each mounting block having a center through hole for the insertion of one support, a mounting groove at one end, and a sliding groove at an opposite end;

a plurality of wedges respectively fitted into the mounting grooves of said mounting blocks to fastened said mounting blocks together;

a plurality of transverse panels respectively fastened to said mounting blocks between each pair of supports to close the four sides of the outer case, each transverse panel having two opposite ends respectively fitted into the sliding grooves of said mounting blocks, one of said transverse panels having a half-round notch in the middle at a bottom side matched with the half-round notch on the upright side walls of said base to provide a circular outlet; and a top cover covered on said supports, said mounting blocks, and said transverse panels at a top side opposite to said base.

* * * * *